United States Patent [19]

Moberg et al.

[11] 3,980,337

[45] Sept. 14, 1976

[54] LOCKING SEAL

[75] Inventors: Sigurd Manfred Moberg, Orange; George Lundberg, Pompton Lakes, both of N.J.

[73] Assignee: E. J. Brooks Company, Newark, N.J.

[22] Filed: Sept. 10, 1973

[21] Appl. No.: 395,416

Related U.S. Application Data

[63] Continuation-in-part of Ser. No. 313,161, Dec. 7, 1972, abandoned.

[52] U.S. Cl. ..... 292/319

[51] Int. Cl.[2] ..... B65D 33/34

[58] Field of Search ..... 24/19; 70/18; 287/DIG. 7; 292/307, 317, 318, 319, 320, 327, 256.65; 339/75, 217 J, 217 S, 91, 74, 253

[56] References Cited

UNITED STATES PATENTS

| | | | |
|---|---|---|---|
| 848,879 | 4/1907 | Brown | 292/318 |
| 932,159 | 8/1909 | Miller | 292/318 |
| 1,097,913 | 5/1914 | Campbell | 292/318 |
| 1,397,101 | 11/1921 | Kelly | 292/324 |
| 1,800,943 | 4/1931 | Junkunc | 70/18 |
| 2,771,768 | 11/1956 | Tudor | 70/457 |
| 3,650,182 | 3/1972 | Phillips | 292/256.6 |
| 3,730,578 | 5/1973 | Gerlach | 292/318 |
| 3,765,196 | 10/1973 | Balicki | 70/18 X |

FOREIGN PATENTS OR APPLICATIONS

| | | | |
|---|---|---|---|
| 392,629 | 3/1924 | Germany | 292/324 |
| 11,644 | 5/1909 | United Kingdom | 292/318 |

*Primary Examiner*—Richard E. Moore
*Attorney, Agent, or Firm*—Robert E. Ross

[57] ABSTRACT

A locking seal for use on doors of freight cars, trailer trucks and other large doors to prevent casual pilferage by non-professional thieves. In a first embodiment a length of steel cable is provided with means on each end for locking engagement with each other. In a second embodiment of the invention, a length of steel cable is provided with a stop on one end and the other end is provided with an assembly comprising a locking cap and means secured to the cable for receiving the locking cap in non-removable engagement. The locking means of either embodiment is adapted for rapid assembly without the use of special tools, yet the design of the two locking portions thereof gives the assembly a strength of engagement which is greater than the strength of the steel cable connecting the portions. The male portion of the locking means, when assembled, is completely enclosed within the female portion to protect the attachment of the cable to the male portion from physical damage. In the first embodiment, sufficient length of cable is provided between the two portions to provide a relatively large loop when the parts are assembled so that an attempt to break the seal by twisting the cable is sufficiently time-consuming as to hamper and discourage pilferage by non-professional thieves such as juveniles. In the second embodiment, the length of cable between the stop at one end and the locking assembly at the other is sufficient to enable the seal to be assembled through an article to be sealed, with sufficient excess length to make rupture of the seal by the use of pry-bars, hammers, or the like difficult or impossible.

2 Claims, 14 Drawing Figures

LOCKING SEAL

BACKGROUND OF THE INVENTION

This application is a continuation-in-part of our application Ser. No. 313,161 filed Dec. 7, 1972, now abandoned.

The doors of railroad cars, trailer trucks, and the like are customarily closed with a seal which is not intended to prevent the door from being opened, but indicates when the door has been opened by unauthorized personnel. Nevertheless the presence of the seal on the door has provided a psycological deterrent to casual pilferage.

In recent years there has been a great increase in thefts from railroad cars and from trailer trucks being carried on open flat-bed railroad cars while the cars are in railroad freight yards, such thefts being often made by non-professional thieves such as juveniles, who will break the seal on a car in a remote location of the yard, throw out any portable items, and escape before they can be detected or apprehended. Even if such thefts are detected early enough to recover the material removed from the car, the fact that the seal on the car has been broken makes the entire contents subject to rejection at its destination. It has been found impractical to lock the cars with padlocks, for example, because of the problem of transfer of keys, and also padlocks can be broken by being twisted with an iron bar, which is an implement readily available to juveniles and non-professional thieves.

Various devices have been proposed for attachment to the latch of a railroad car to prevent such pilferage, however none has been found sufficiently satisfactory to be generally adopted, since they require special tools for assembly, or are too time-consuming in assembly, or have inadequate resistance to rupture by twisting. The requirement that a special tool be used is generally unacceptable to the railroad industry, not only because of the extra time required to seal the door of a car, but also because of the delay that would result if the tool were misplaced.

Hence the ideal seal for such application should be easily and rapidly assembled by hand, sufficiently strong to resist fracture by twisting, and it should have no exposed portions, such as cable ends, that might injure personnel using the seal.

SUMMARY OF THE INVENTION

The first embodiment of the invention described in this application utilizes a length of relatively stiff steel cable having a fastener portion attached to each end thereof, said fastener portions being easily snapped together into non-removable engagement that can resist tensile forces at least as great as the breaking strength of the cable. In one embodiment of the invention one part of the fastener comprises a housing with an internal cavity and a locking ring disposed in an annular recess. The other portion of the fastener comprises a protruding stud portion adapted to be inserted into the housing, said stud having means for being non-removably engaged by the locking ring. The annular recess in the housing in which the locking ring is held is so shaped that the ring has a limited amount of axial movement. On insertion of the stud, the ring moves forwardly into a portion of the recess in which it can expand to pass over the end of the stud and snap into a peripheral recess thereon; however when tensile forces are applied to the assembly, the ring is carried on the stud to the forward end of the recess, which is so shaped as to apply a constricting force to the ring to cause it to grip the stud tightly and form an immovable collar on the stud which jams between the stud and the housing, preventing the stud from coming out of the housing.

In a modification of this embodiment of the invention the protruding stud portion is provided with a retaining ring held in a circumferential recess and the housing is provided with an internal annular groove. The ring is capable of being compressed in the recess in the stud to that it can be pushed into the housing, where it expands into the annular groove. The recess in the stud is so shaped that disengaging forces applied to the stud and housing cause the ring to expand and bear tightly against the housing forming an immovable collar on the stud which jams between the stud and the housing.

Another feature of this embodiment of the invention lies in the fact that the length of cable between the fastener portions is such that when the fastener portions are assembled into the door latch, the loop formed by the cable is sufficiently large that if an attempt is made to fracture the cable or fastener by inserting a bar through the cable loop and twisting, a considerable number of turns are required before any appreciable tension is applied to the assembly. The time required for this procedure is often sufficient to allow detection and prevention of the theft. The strength of the cable and fastener assembly is also so great that with a bar of any reasonable length, it is difficult for a juvenile to apply sufficient force to the assembly to cause failure.

In the second embodiment of the invention, a shackle comprising of a length of cable is provided with an enlarged stop member secured to one end, and an assembly at the other end comprising a first fastener portion attached to the other end of the cable, and a second fastener portion designed for non-removable assembly with the first fastener portion to provide a stop at said other end of the cable so that, the cable, prior to assembly of the second fastener portion onto the first fastener portion, may be inserted through the staple of a door latch. After assembly of the second fastener portion the seal cannot be removed from the staple without cutting the cable.

The fastener portions utilized in the second embodiment of the invention may be similar to the fastener portions of either modification of the first embodiment described above with interengaging male and female portions which when assembled, are locked together by an internal spring.

DESCRIPTION OF THE FIGURES OF THE DRAWING

FIG. 7 is a view of the seal assembled with the door latch of a door of a railroad car or the like;

DESCRIPTION OF THE ILLUSTRATED EMBODIMENTS

Figure 1:
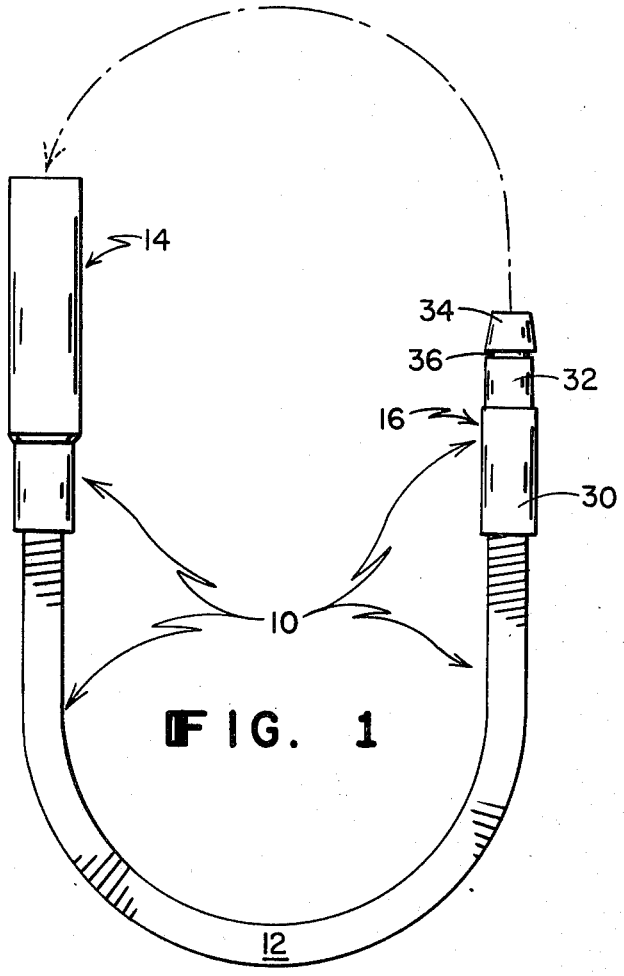
FIG. 1 is a plan view of the first embodiment of a seal embodying the features of the invention.

Referring to FIGS. 1 to 6, there is illustrated a first embodiment of the invention, comprising a seal 10 which comprises a length of cable 12 having a female fastener portion 14 attached to one end thereof and a male fastener portion 16 attached to the other end. The cable 12 is formed of steel and is relatively stiff and resistant to bending in short lengths, however the length of the cable between the fastener portions is sufficient to allow the fastener portions to be assembled in locking relation, forming the cable into a relatively large loop.

The female fastener portion 14 comprises an elongated housing having an aperture 18 at one end receiving one end of the cable 12, the portion 20 of the housing around the cable end being crimped into engagement therewith.

An aperture for receiving the male fastener portion is provided at the other end of the housing, said aperture having an outer portion 22 and an inner smaller portion 24 dimensioned to receive corresponding portions of the male fastener. The inner portion of the aperture is provided with a peripheral recess 26 in which is retained a locking ring 28 for locking engagement with the male fastener in a manner to be described.

The male fastener 16 comprises a hollow end portion 30 crimped around the other end of the cable 12 and a protruding stud portion 32 having a tapered forward portion 34 and a peripheral groove 36.

The relative dimensions of the inner portion 24 of the aperture of the female fastener 14, the recess 26, the locking ring 28, and the end portion 30 of the male fastener 16 are critical to the proper operation of the device, as will now be described.

The locking ring 28 is formed of strong resilient material and has a gap 38, so that the ring is expandable and contractable. In the normal un-flexed condition, the outside diameter of the ring is greater than the inside diameter of the inner portion 24 of the housing aperture. The gap 38 is sufficiently wide to allow the ring to be compressed so that the diameter is smaller than the diameter of the portion 24 of the housing aperture, so that the ring can be assembled into the recess 26 by compressing it and inserting it through the aperture to the recess, where it expands and retains itself therein.

The diameter of the stud 32 just forward of the recess 36 is greater than the inside diameter of the ring in the normal unflexed condition, so that when the stud 32 enters the housing, the ring must expand to pass over the end of the stud. The recess 26 therefore has a maximum diameter at the innermost portion which is greater than the diameter of the ring when so expanded, that is, greater than the diameter of said portion of the stud plus twice the thickness of the ring.

The diameter of the recess 36 in the stud is substantially the same as the internal diameter of the ring. The recess 26 in the housing has a forward wall 40 which is relatively abrupt so that forward forces on the ring do not cause peripheral contraction thereof, and a rear wall 42 which tapers inwardly, so that rearward forces on the ring do cause peripheral contraction thereof.

The assembly of the seal with a latch 44 of a door is easily and rapidly accomplished by passing one end of the seal through the staple of a door latch and pushing the male portion of the fastener assembly into the female portion. As the tapered end 34 of the stud enters the ring, the ring is forced forwardly as far as it can go into the largest portion of the recess 36 and is expanded by the tapered end. When the groove on the stud reaches the position of the ring, the ring snaps into the groove and retains itself therein.

Thereafter when tensile forces are applied to the assembly, the ring tends to be carried by the stud in a rearward direction and contacts the inwardly sloping rear wall 42 of the recess 26. The wall 42 causes constricting forces in the ring, which causes the ring to grip the stud more tightly as the tensile force increases. Since the outside diameter of the ring in this position is greater than the inside diameter of the inner portion 24 of the housing aperture, and the ring is prevented from contracting by the stud on which it is now retained, the fastener portions cannot be separated once they have been assembled. It has been found that the strength of engagement of the fastener portions is greater than the strength of the cable 12.

For reasons of economy and also to keep the greatest diameter of the device at a minimum, the portion of the fasteners surrounding the cable is made as thin as possible and still providing the necessary strength of engagement. The weakest portion of the fastener is therefore the wall portion of the male fastener surrounding the cable. To provide additional support for this portion, the design of the two components enables the male portion to fit entirely inside the female portion.

Figure 7:
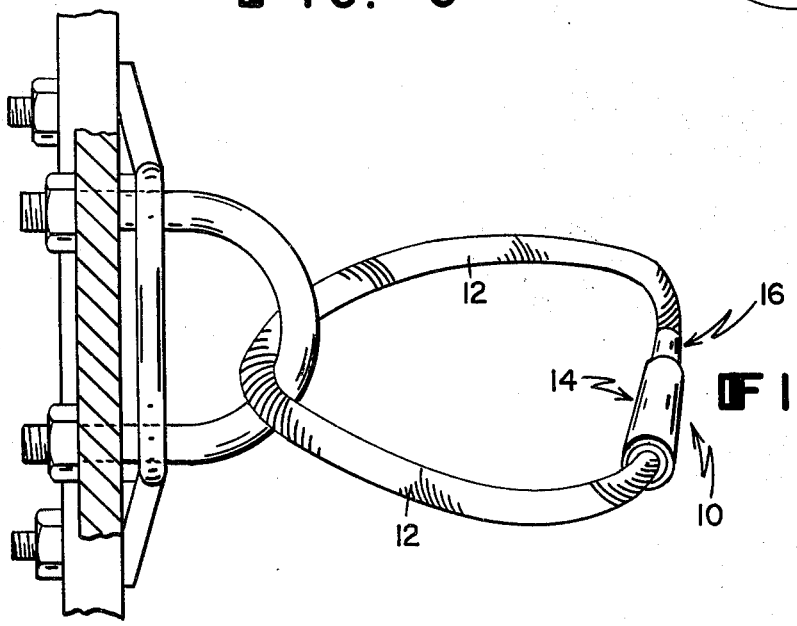
Figure 8:
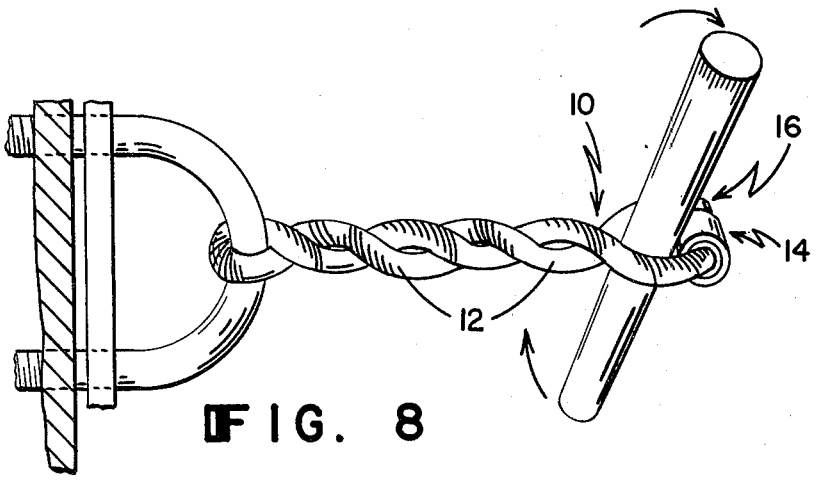
FIG. 8 is a view of the assembly of FIG. 7 after it has been twisted by the use of a pry-bar or similar tool.

An important feature of the structure is the fact that the cable 12 has considerable length in excess of that needed merely to assemble it with a door latch, so that when assembled, a relatively large loop is formed (See FIG. 7) The extra large loop provides two advantages. If an attempt is made to break the seal by twisting with an iron bar or other tool inserted through the loop, a considerable number of turns of the bar is required before any tension is applied to the fastener, and second, the multiple twists applied to the cable tend to absorb, due to friction in the cable twists, the resulting tensile force reaching the fastener.

Considerable time is required to accomplish sufficient twisting to apply any appreciable tension to the fastener, and the strength of the assembly makes it necessary to use a bar of longer length than is readily available to casual or non-professional thieves.

Figure 9:
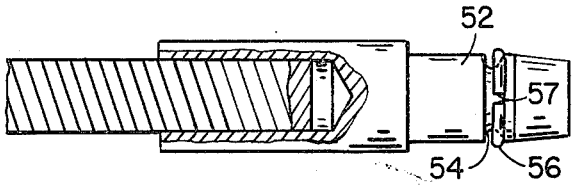
FIG. 9 is a plan view of the male member of a modified form of a seal embodying the features of the invention.

Referring now to FIGS. 9 to 12 of the drawing, there is illustrated a modification of the first embodiment of the invention, having a housing 50 and a stud 52 similar in many respects to the housing and stud previously described. In the embodiment of FIG. 9 the stud 52 has substantially the same dimensions as the stud previously described, however the forward end of the stud is provided with a recess 54 and a locking ring 56 assembled therein. The recess 54 has a rear portion 58 which is sufficiently deep that the ring can contract therein enough to allow the ring to pass through the inner opening 60 of the housing, and a larger forward portion 62 connected to the portion 58 by an inclined surface.

The housing 50 has an internal groove 66 which is semi-circular in cross-section, into which the ring expands when the stud is fully inserted into the housing. During such insertion the ring is forced into the rear portion 58 of the recess on the stud, where it is free to be circumferentially contracted by its passage through the inner portion 60 of the housing. However, when disengaging forces are applied to the two portions of the seal, the ring, being seated in the recess 66, is prevented from moving and the initial small rearward movement of the stud causes the ring to be expanded by engagement with the inclined surface 64, forcing the ring tightly into the housing groove, so that increasing tensile force jams the ring tightly between the housing and the stud.

The other features and method of use of the seal of FIGS. 9 to 12 are the same as those of the device illustrated in FIGS. 1 to 6 previously described.

Figure 13:
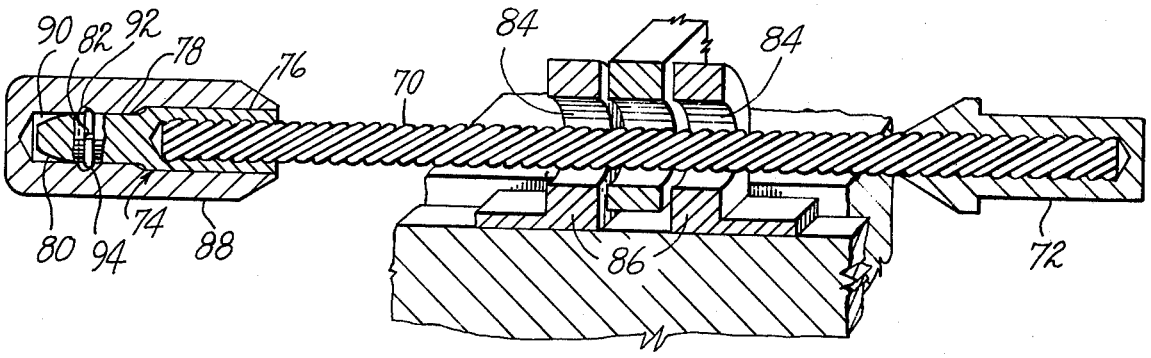
FIG. 13 is a plan view of a second embodiment of the invention.
Figure 14:
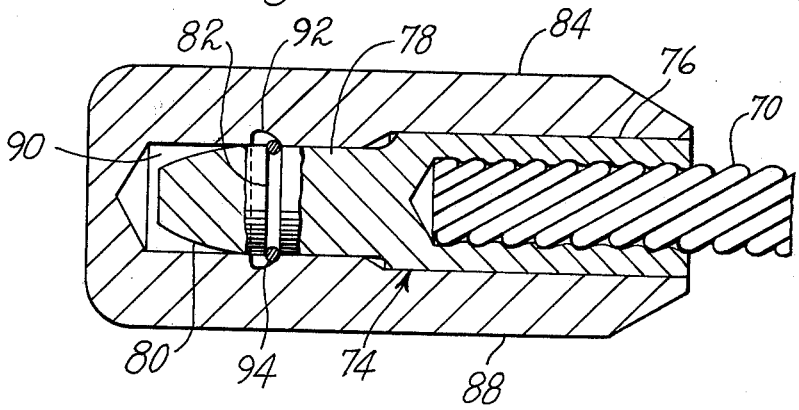
FIG. 14 is an enlarged view of the locking portions of the embodiment of FIG. 13.

Referring to FIG. 13, there is illustrated a second embodiment of the invention, which comprises a length of cable to having a stop member 72 secured to one end thereof and a fastener portion 74 secured to the other end thereof.

In the illustrated second embodiment the fastener portion 74 is a male fastener portion similar to the male fastener portion 16 of the first embodiment illustrated in FIGS. 1, and 3–5 and 6 and comprises a hollow end portion 76 crimped around the end of the cable 70 and a protruding stud portion 78 having a tapered forward portion 80 and a peripheral groove 82.

The male fastener portion 74 is dimensioned so that it can pass freely through apertures 84 of door latch members 86 and receive a female fastener portion 88 in locking non-removable engagement. The female fastener portion 88 is similar in construction to the female fastener portion 14, and comprises an elongated housing having an aperture 90 for receiving the stud 78 of the male fastener member, said aperture having an internal circumferential recess 92 in which is retained a locking ring 94 for locking engagement with the male member in the manner previously described in connection with the first embodiment. The shape of the recess 92 is similar to the shape of the recess in the previously described fastener portion 14 so that the ring 94, on insertion of the stud, can expand to pass over the front end of the stud and snap into the stud groove 82. Attempts to thereafter separate the two fastener portions is rendered impossible because of the contracting force applied to the ring by the recess 92 when tensile forces are applied to the fastener portion in the manner previously described.

The external diameter of the female fastener portion 88 is greater than the diameter of the apertures 84, as is the external diameter of the stop 72 so that after insertion of the male fastener member 74 through the apertures 84 and seembly of the female fastener 88 thereon, the cable 70 is non-removably retained in the door latch apertures.

For use in the specific application mentioned in the Background of this Invention, the stop member 72 and the fastener portions 74 and 88 are made of steel, so that they cannot be fractured by a blow with a hammer, and the cable is also made of steel, so that the entire assembly has sufficient strength that it cannot be fractured with a hammer or a claw type crow-bar. The cable also has sufficient length to make the use of a claw hammor or claw type crow-bar to apply tension to the seal by using the door latch members to pry against.

Figure 2:
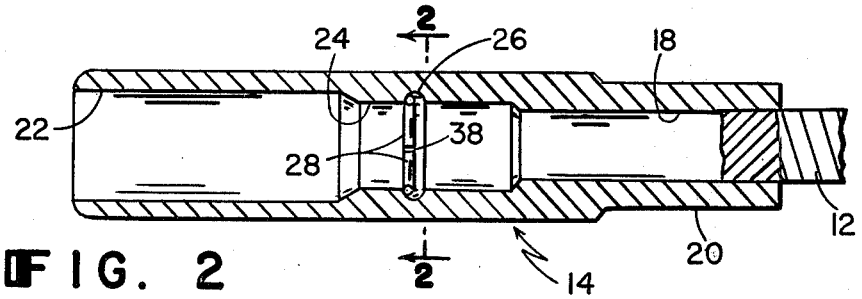
FIG. 2 is a view in longitudinal section of the female portion of the fastener.
Figure 3:
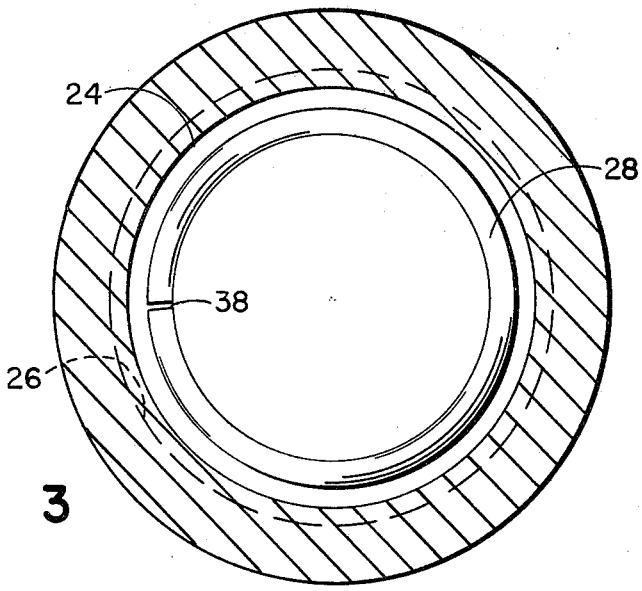
FIG. 3 is a view in section taken on line 3—3 FIG. 2.
Figure 4:
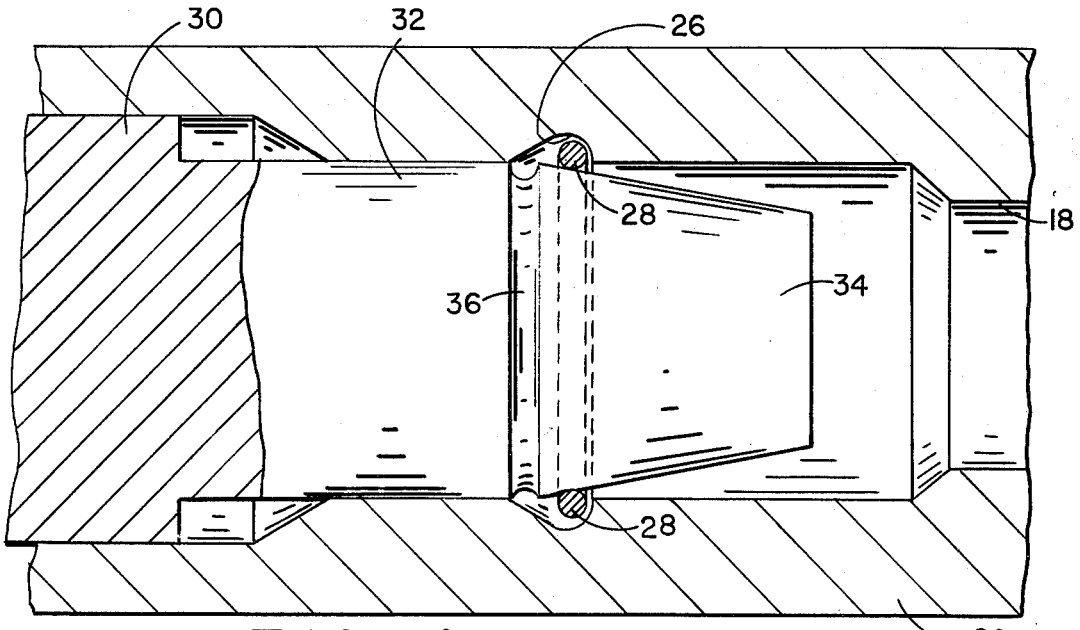
FIG. 4 is an enlarged view in longitudinal section of the male member being assembled into the female portion, illustrating the action of the forward portion of the male member in expanding the ring and pushing it into the larger portion of the recess.
Figure 5:
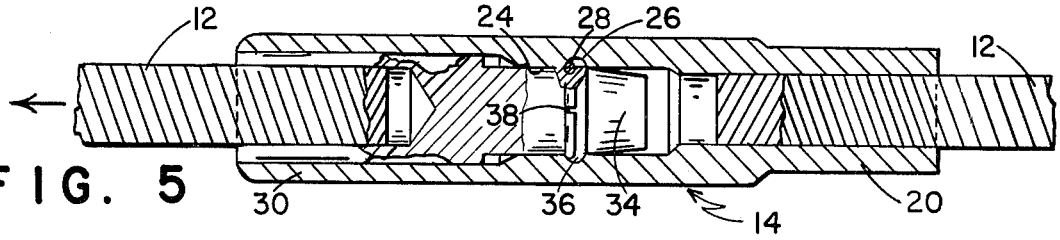
FIG. 5 is a view in longitudinal section of the assembled portions of the fastener.
Figure 6:
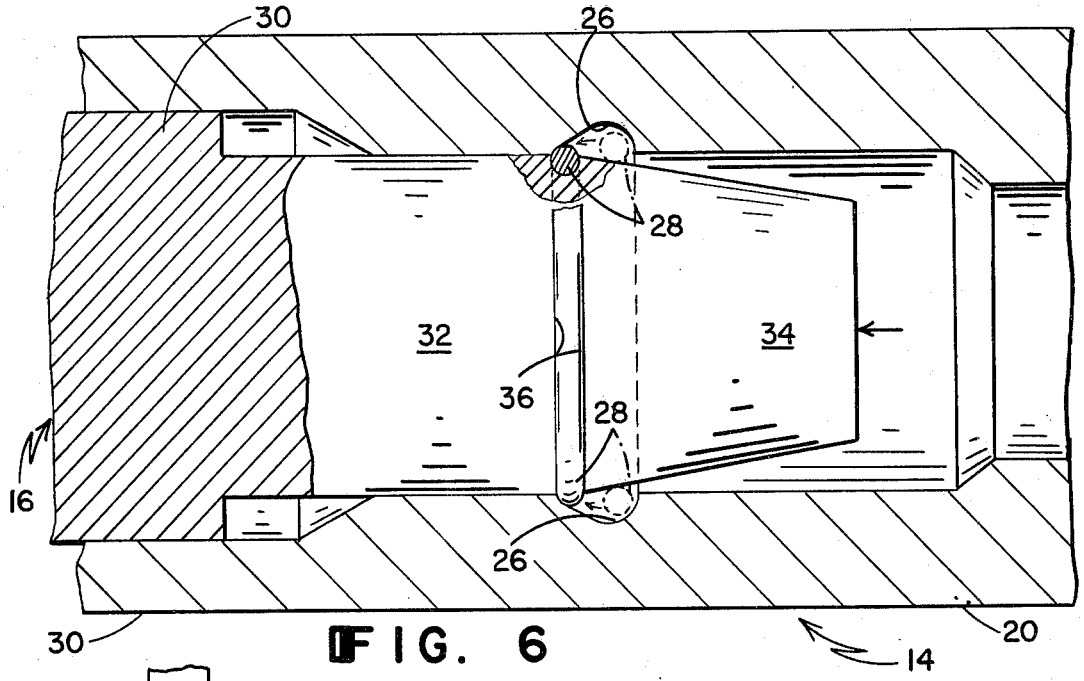
FIG. 6 is an enlarged view of the center portion of the assembled portions, illustrating the action of the components when tension is applied thereto.
Figure 10:
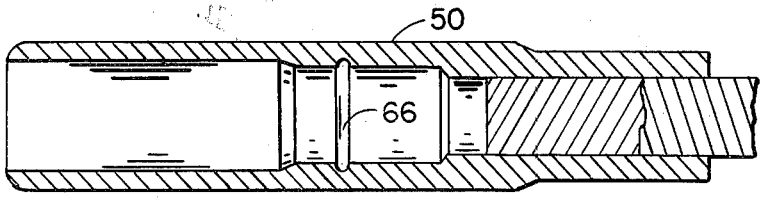
FIG. 10 is a view in section of a female member of the modified form of fastener.
Figure 11:
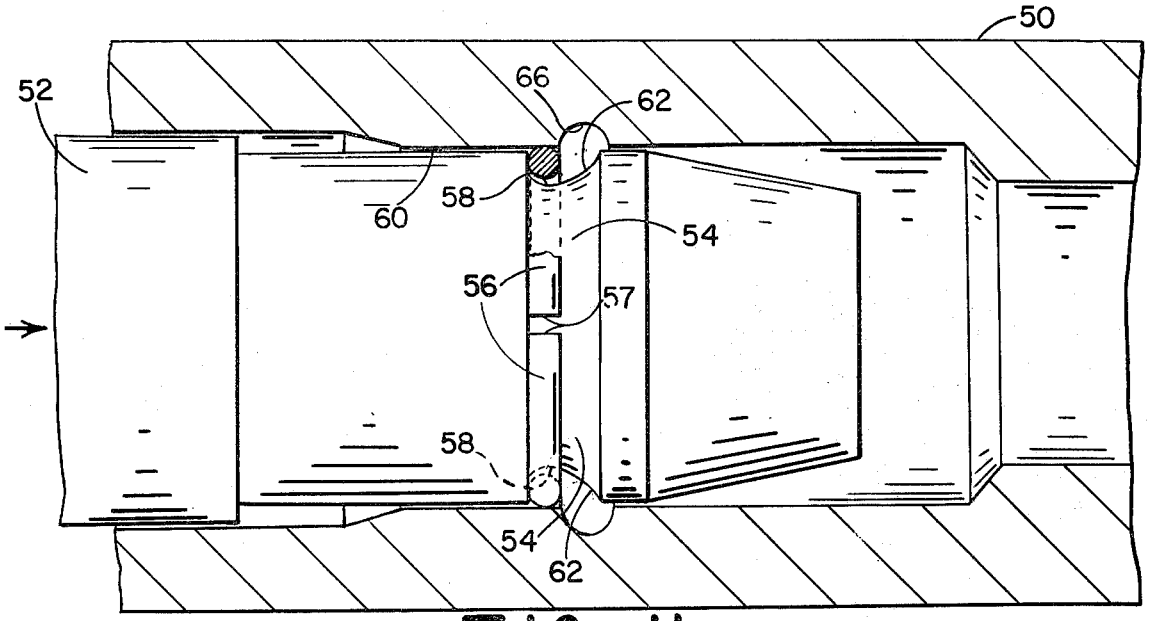
FIG. 11 is an enlarged view of the center portion of the fastener portions of FIGS. 9 and 10 after assembly.
Figure 12:
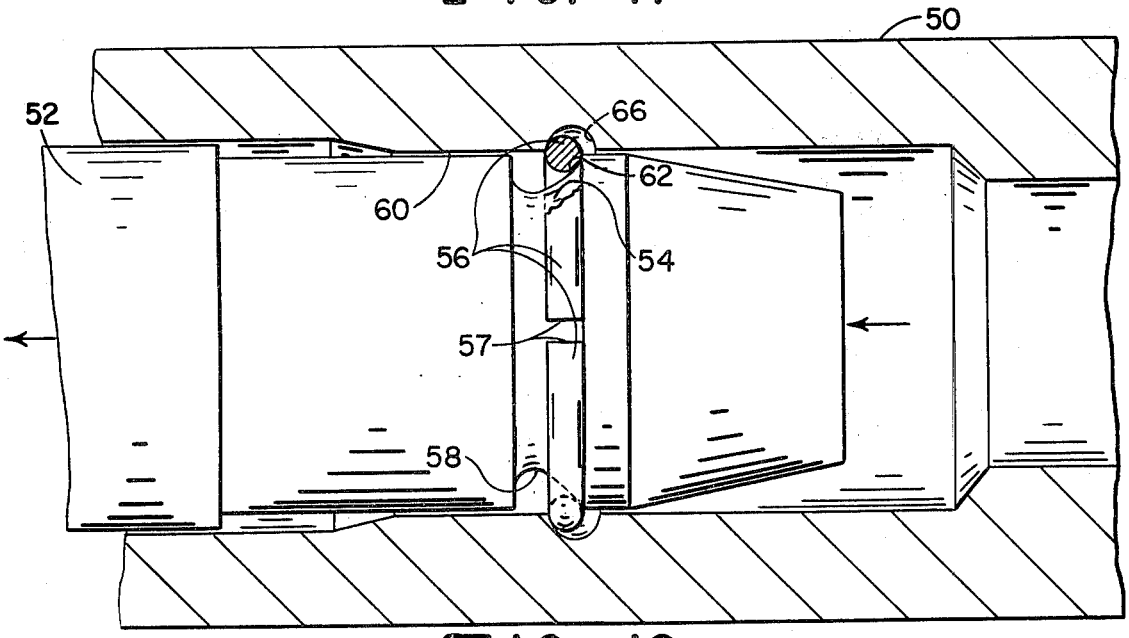
FIG. 12 is a view of the assembly of FIG. 11 illustrating the action of the components when tension is applied thereto.

Although in the second embodiment illustrated, the male fastener member is secured to the cable and the female member is a separate member to be assembled thereon, in some cases the female member may have the configuration of the female member of the embodiment of FIG. 2 or FIG. 10, and be attached to the cable, the male member will, in such case be a separate member having generally the configuration of FIGS. 1 or 9, respectively, however, no cable receiving aperture will be required.

In any modification of the second embodiment, the cable ends are completely enclosed to prevent injury to personnel handling the seal.

Although in the illustrated embodiments the fasteners and the cable are made of steel because of the strength required in the intended applications, the components may be made of other materials such as plastic for use in less demanding applications.

Since certain other modifications may be made in the device without departing from the scope of the invention, it is intended that all matter contained herein be interpreted in an illustrative and not a limiting sense.

We claim as our invention:

1. A locking seal, comprising an elongated shackle formed of stranded cable and a fastener portion attached to each end of the shackle, each of said fastener portions having a rear portion surrounding and engaging an end of the cable, one fastener portion having a forwardly extending stud portion, the other fastener portion having a socket portion formed by a forwardly extending peripheral wall forming an internal aperture for receiving the stud portion said portions having cooperating means to effect locking engagement when the stud portion is inserted into the internal aperture in the socket portion, said portions being so dimensioned that when the stud portion is assembled into the socket portion the forwardly extending peripheral wall of the socket portion closely surrounds the rear portion of said one fastener portion and the end of the cable assembled therein.

2. A locking seal, comprising an elongated shackle formed of stranded cable having an enlarged stop member attached to one end thereof, a first portion of a fastener assembly attached to the other end thereof, and a second portion of the fastener assembly shaped and arranged for locking engagement with the first portion after it has passed through an aperture of a device to be sealed, said first portion of the fastener assembly having a rear portion surrounding and engaging the other end of the cable and a forwardly extending stud portion, said second portion of the fastener assembly comprising a housing having an internal aperture for receiving the first fastener portion, the portions being so dimensioned that when assembled, the first portion and said other end of the cable are surrounded and protected by said second portion.

* * * * *